US007980438B2

(12) United States Patent
Lin

(10) Patent No.: US 7,980,438 B2
(45) Date of Patent: Jul. 19, 2011

(54) LATCH ASSEMBLY FOR A STAPLE GUN

(76) Inventor: Jui-Yuan Lin, Dali (TW)

( * ) Notice: Subject to any disclaimer, the term of this patent is extended or adjusted under 35 U.S.C. 154(b) by 171 days.

(21) Appl. No.: 12/360,595

(22) Filed: Jan. 27, 2009

(65) Prior Publication Data

US 2010/0187279 A1 Jul. 29, 2010

(51) Int. Cl.
*B27F 7/07* (2006.01)

(52) U.S. Cl. ..... 227/8; 227/130; 227/132

(58) Field of Classification Search ..... 227/8, 130, 227/132, 134, 136, 142
See application file for complete search history.

(56) References Cited

U.S. PATENT DOCUMENTS

| | | | | |
|---|---|---|---|---|
| 1,945,377 | A * | 1/1934 | Posnack | 227/123 |
| 7,464,844 | B2 * | 12/2008 | Kamins et al. | 227/132 |
| 2006/0186170 | A1 * | 8/2006 | Marks | 227/120 |
| 2007/0108251 | A1 * | 5/2007 | Marks | 227/120 |
| 2007/0145094 | A1 * | 6/2007 | Chou | 227/132 |

FOREIGN PATENT DOCUMENTS

| | | | |
|---|---|---|---|
| DE | 20 2008 006 249 | U1 | 10/2008 |
| EP | 1839818 | A | 10/2007 |

* cited by examiner

*Primary Examiner* — Rinaldi I Rada
*Assistant Examiner* — Nathaniel Chukwurah
(74) *Attorney, Agent, or Firm* — Apex Juris, pllc; Tracy M. Heims

(57) ABSTRACT

A latch assembly for a staple gun has a front cover, a locking element, a pushing element and a staple driver. The front cover has a connecting bolt. The locking element is mounted on the front cover and has two cams, a torsion spring and a locking block. The cams and the torsion spring are mounted around the connecting bolt. The pushing element is mounted in the front cover and has a pushing lever and a pressing pin. The pushing lever abuts the cams. The pressing pin extends out of the front cover. The staple driver is mounted in the front cover and has a locking hole, a through hole and an elastic panel. The locking hole is formed through the staple driver and engages the locking block. The latch assembly can hold a handle of the staple gun conveniently and safely when the staple gun is not being used.

8 Claims, 6 Drawing Sheets

LATCH ASSEMBLY FOR A STAPLE GUN

BACKGROUND OF THE INVENTION

1. Field of the Invention

The present invention relates to a latch assembly, and more particularly relates to a latch assembly for a staple gun that can hold a handle of the staple gun conveniently and safely when the staple gun is not being used.

2. Description of Related Art

A conventional staple gun is used extensively with decorations, shoemaking and leatherwear and drives staples into objects. Accordingly, the staple is ejected from the staple gun at a high speed. This may be dangerous if a handle of the staple gun is thoughtlessly squeezed, which ejects a staple from the staple gun and may injure someone. Consequentially, conventional staple guns usually have a protection device to hold the handle against the staple gun when the staple gun is not being used to prevent the staples from being shoot from the staple gun.

However, the protection device for the conventional staple gun has a complicated structure and locking the handle to the staple gun by the protection device rubbing against the staple gun isn't easy so the conventional staple gun is inconvenient to use. In addition, the protection device will wear down and will not hold the housing securely after a long time and may get someone hurt.

To overcome the shortcomings, the present invention provides a latch assembly for a staple gun to mitigate or obviate the aforementioned problems.

SUMMARY OF THE INVENTION

The main objective of the present invention is to provide a latch assembly for a staple gun can hold a handle of the staple gun conveniently and safely when the staple gun is not being used.

A latch assembly for a staple gun in accordance with the present invention has a front cover, a locking element, a pushing element and a staple driver. The front cover is detachably mounted on the staple gun and has two bolt holes and a connecting bolt. The locking element is pivotally mounted on the front cover and has at least one cam, a locking block and a torsion spring. The at least one cam is rotatably mounted around the connecting bolt. The locking block is formed with the at least one cam below the connecting bolt. The torsion spring is mounted around the connecting bolt to push the locking block moving backward to the front cover. The pushing element is slidably mounted in the front cover and has a pushing lever and a pressing pin. The pushing lever abuts the at least one cam. The pressing pin extends out of the front cover. The staple driver is mounted slidably between the front cover and the staple gun and has a locking hole, a through hole and an elastic panel. The locking hole is formed through the staple driver and engages the locking block. The through hole is formed through the staple driver. The elastic panel engages the through hole.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
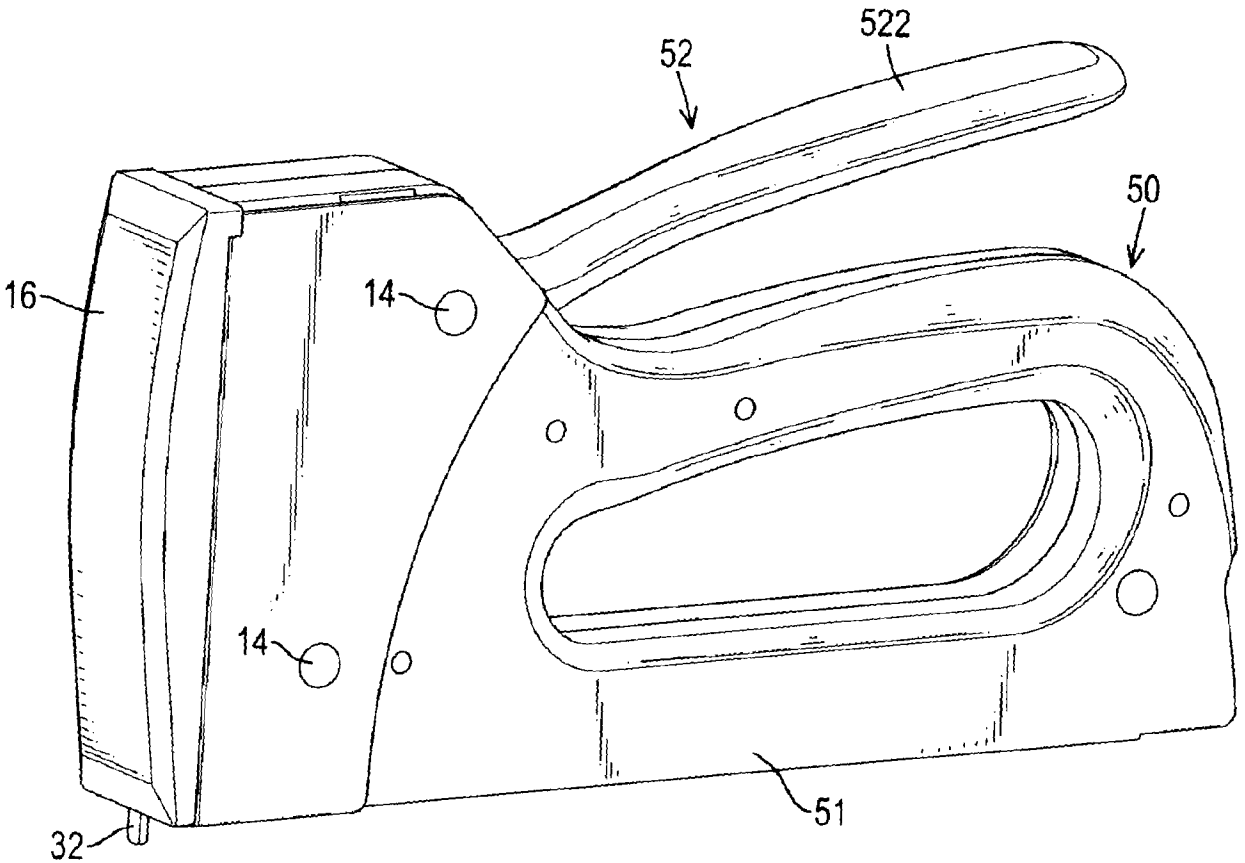
FIG. 1 is a perspective view of a latch assembly for a staple gun in accordance with the present invention, shown mounted on a staple gun.
Figure 2:
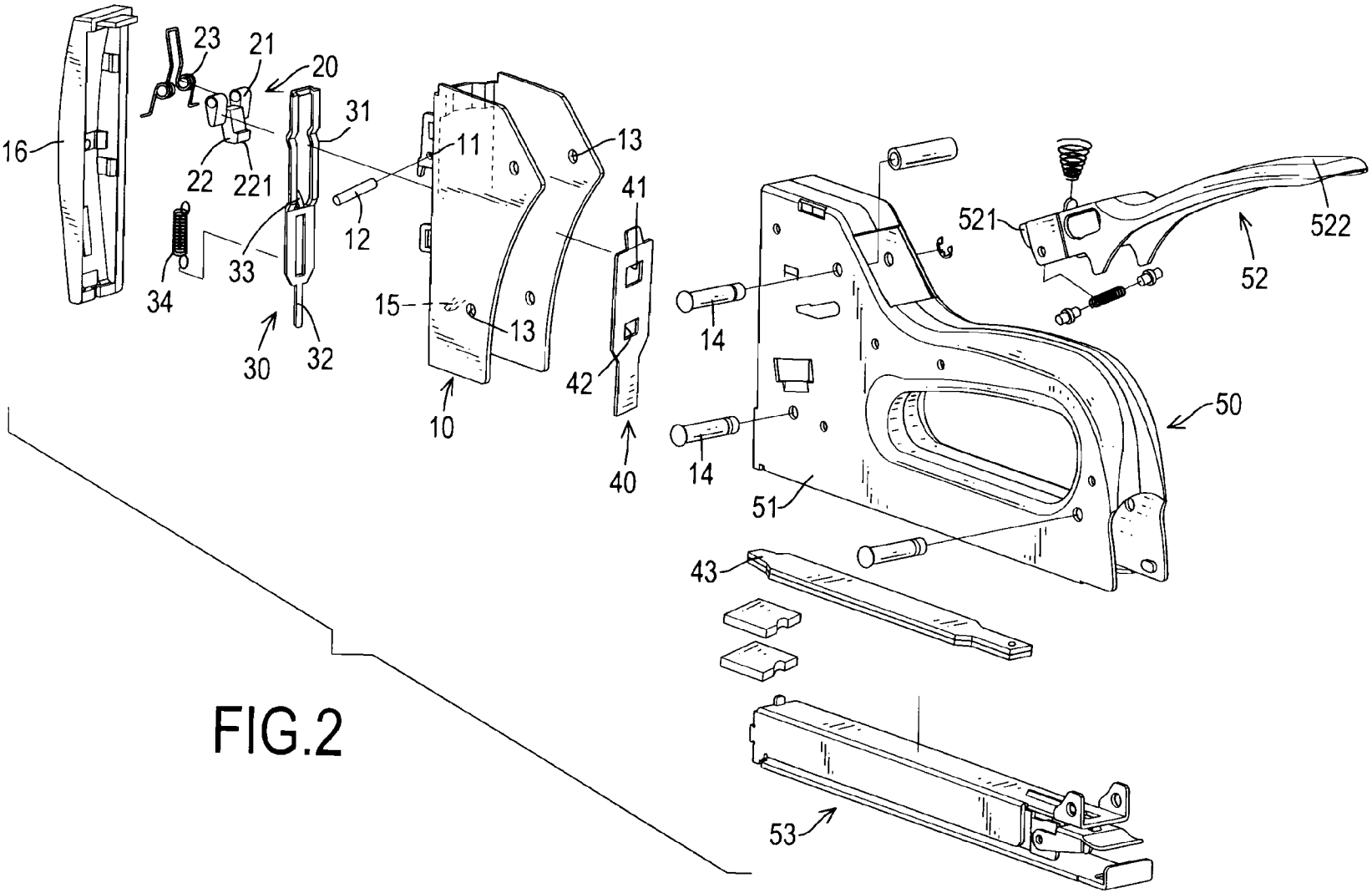
FIG. 2 is an exploded perspective view of the latch assembly and the staple gun in FIG. 1.
Figure 3:
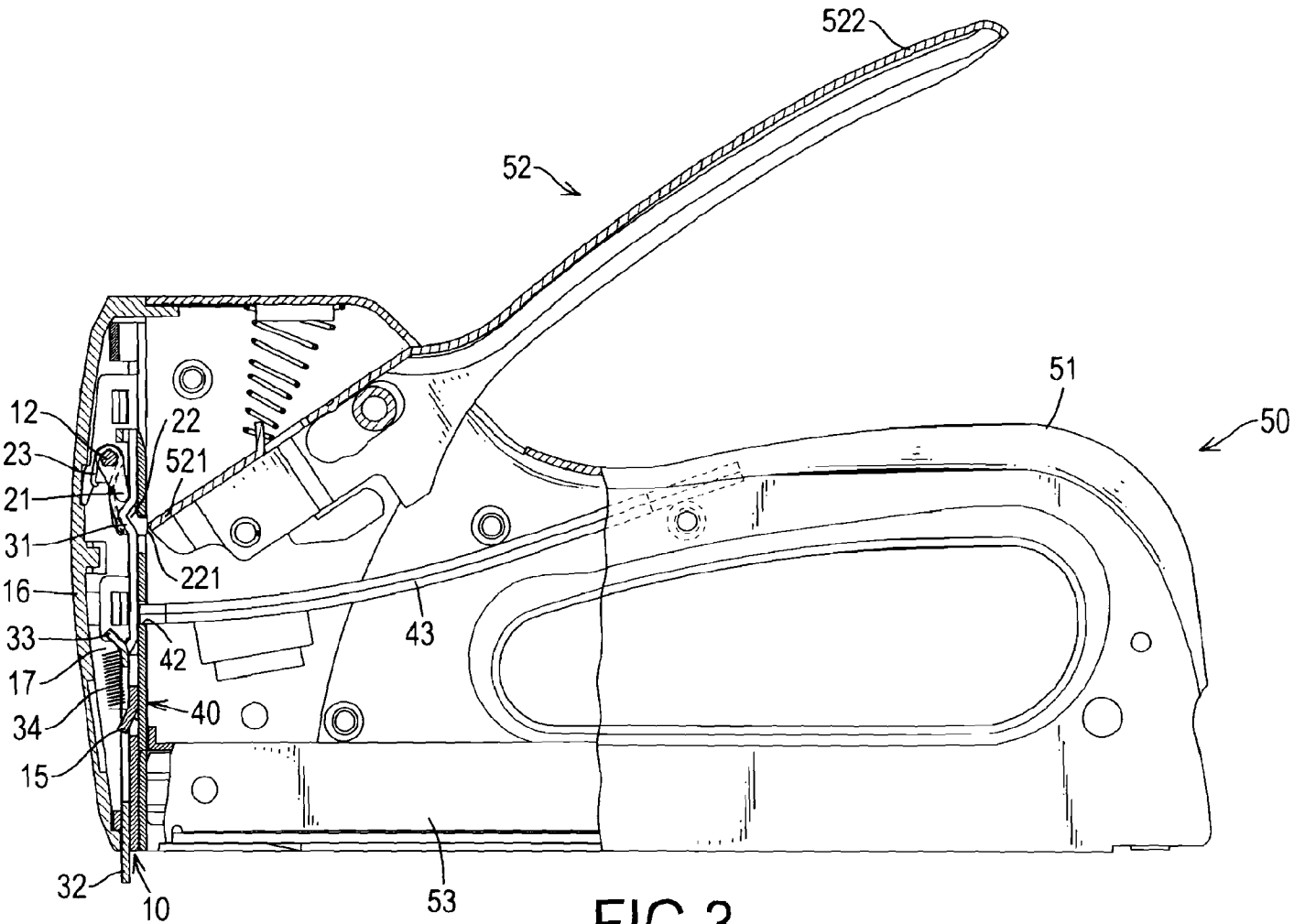
FIG. 3 is a side view in partial section of the latch assembly mounted in the staple gun in FIG. 1.

With reference to FIGS. 1, 2 and 3, a latch assembly in accordance with the present invention is mounted in a staple gun (50) having a housing (51), a handle (52) and a staple magazine (53) and the latch assembly comprises a front cover (10), a locking element (20), a pushing element (30) and a staple driver (40).

The housing (51) is hollow, may be formed by two half-casings and has a front side, a top edge and a bottom edge.

The handle (52) is connected pivotally to the housing (51), protrudes from the top edge of the housing (51) and has an acting end (521) and a pressing end (522). The acting end (521) of the handle (52) is pivotally mounted inside the housing (51) and extends to the front side of the housing (51). The pressing end (522) of the handle (52) extends out of the top edge of the housing (51).

The staple magazine (53) is mounted in the housing (51) at the bottom edge, holds multiple staples and pushes the staples to a front of the staple magazine (53).

The front cover (10) may be U-shaped, is detachably mounted on the front side of the housing (51) and has a top, a bottom, a front side, two sidewalls, two bolt holes (11), a connecting bolt (12), multiple mounting holes (13), multiple fasteners (14), a first spring mount (15) and a protecting cap (16).

The bolt holes (11) are transversally formed through the front side of the front cover (10) near the top and align with each other.

The connecting bolt (12) is mounted in the bolt holes (11) of the front cover (10).

The mounting holes (13) are formed through the sidewalls of the front cover (10) and align with each other.

The fasteners (14) are mounted in the mounting holes (13) of the front cover (10) to connect the front cover (10) with the housing (51) of the staple gun (50).

The first spring mount (15) is formed on and protrudes from the front side of the front cover (10) near the bottom.

The protecting cap (16) is detachably mounted on the front side of the front cover (10) to form a mounting recess (17) between the front cover (10) and the protecting cap (16).

The locking element (20) is pivotally mounted on the front cover (10) and has at least one cam (21), a locking block (22) and a torsion spring (23). The at least one cam (21) may be water drop shaped, is rotatably mounted around the connecting bolt (12) of the front cover (10). Preferably two cams (21) are rotatably mounted around the connecting bolt (12).

The locking block (22) is formed with the at least one cam (21) below the connecting bolt (12), may be formed between the two cams (21) and has a locking end (221). The locking end (221) of the locking block (22) is extended to the front side of the front cover (10).

The torsion spring (23) is mounted around the connecting bolt (12) of the front cover (10) to push the locking block (22) to the front side of the front cover (10).

The pushing element (30) is slidably mounted in the mounting recess (17) between the front cover (10) and the protecting cap (16) and has an upper end, a lower end, a pushing lever (31), a pressing pin (32), a second spring mount (33) and a pushing spring (34).

The pushing lever (31) is formed on the upper end of the pushing element (30) and abuts the at least one cam (21).

The pressing pin (32) is formed on the lower end of the pushing element (30) and extends out of the bottom of the front cover (10).

The second spring mount (33) is formed on and protrudes from the pushing element (30) above the first spring mount (15) of the front cover (10).

The pushing spring (34) is mounted between the spring mounts (15, 33) to press the pressing pin (34) downward to extend out of the bottom of the front cover (10).

The staple driver (40) is mounted slidably between the front cover (10) and the housing (51) of the staple gun (50) and has a lower end, an upper end, a locking hole (41), a through hole (42) and an elastic panel (43).

The lower end of the staple driver (40) extends over the staple magazine (53) of the staple gun (50).

The locking hole (41) is formed through the staple driver (40) near the upper end, engages the locking end (221) of the locking block (22) and aligns with the acting end (521) of the handle (52).

The through hole (42) is formed through the staple driver (40) below the locking hole (41).

The elastic panel (43) engages the through hole (42) of the staple driver (40) in the housing (51) of the staple gun (50) to provide an impulsive force to the staple driver (40) to eject the staples in the staple magazine (53) out of the staple gun (50).

Figure 4:
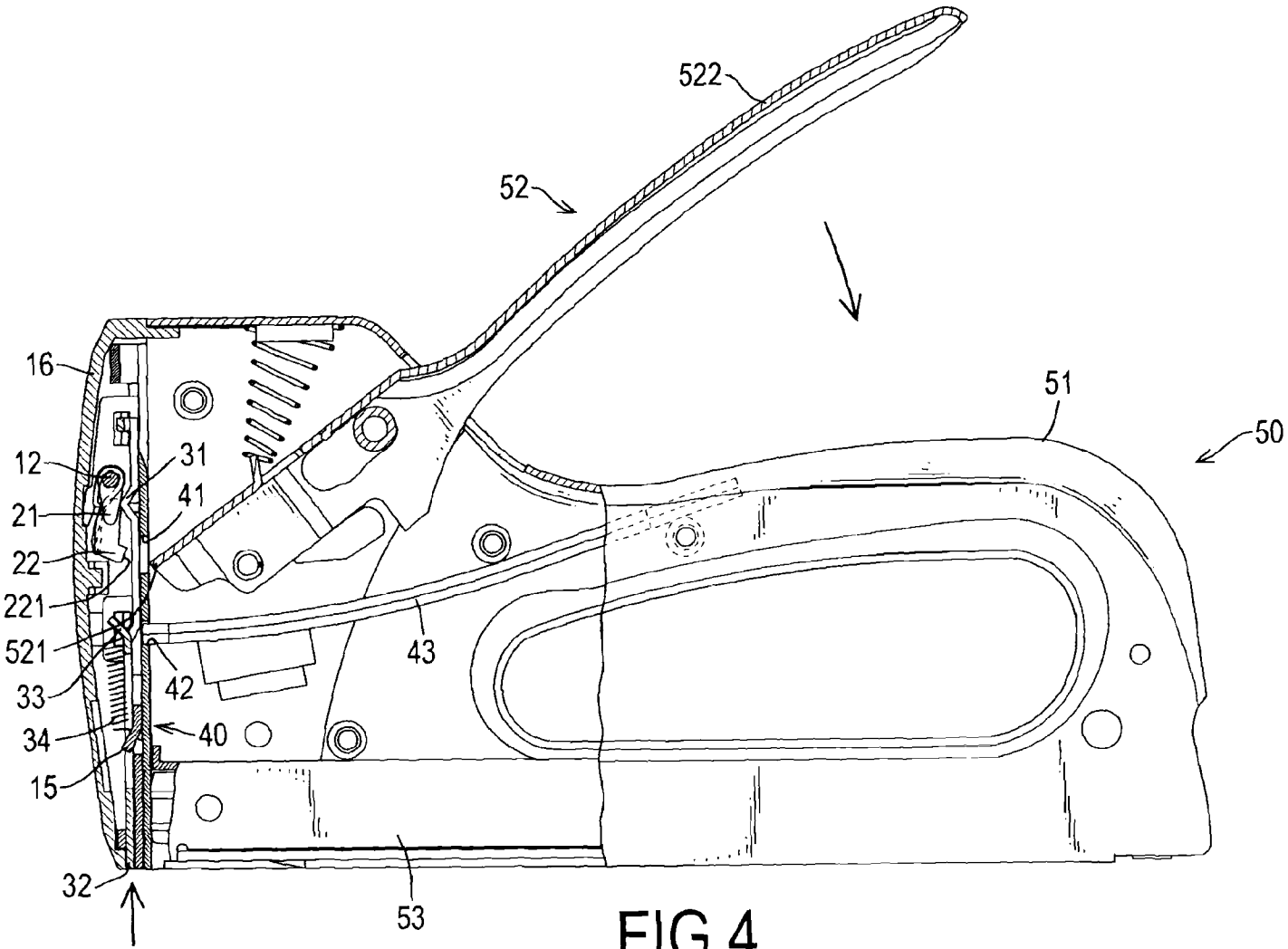
FIGS. 4 to 6 are operational side views in partial section of the latch assembly mounted in the staple gun in FIG. 1.
Figure 5:
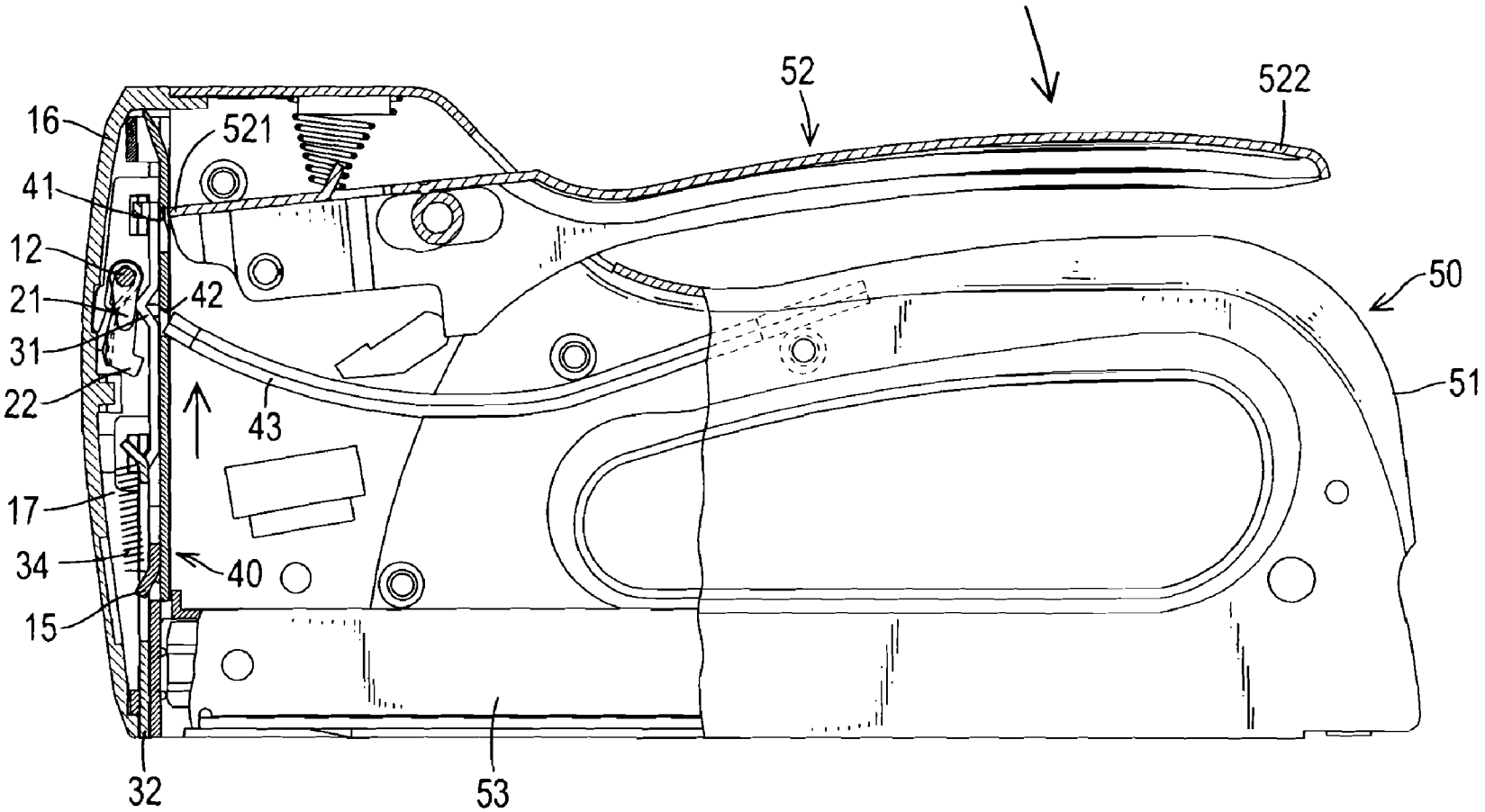
Figure 6:
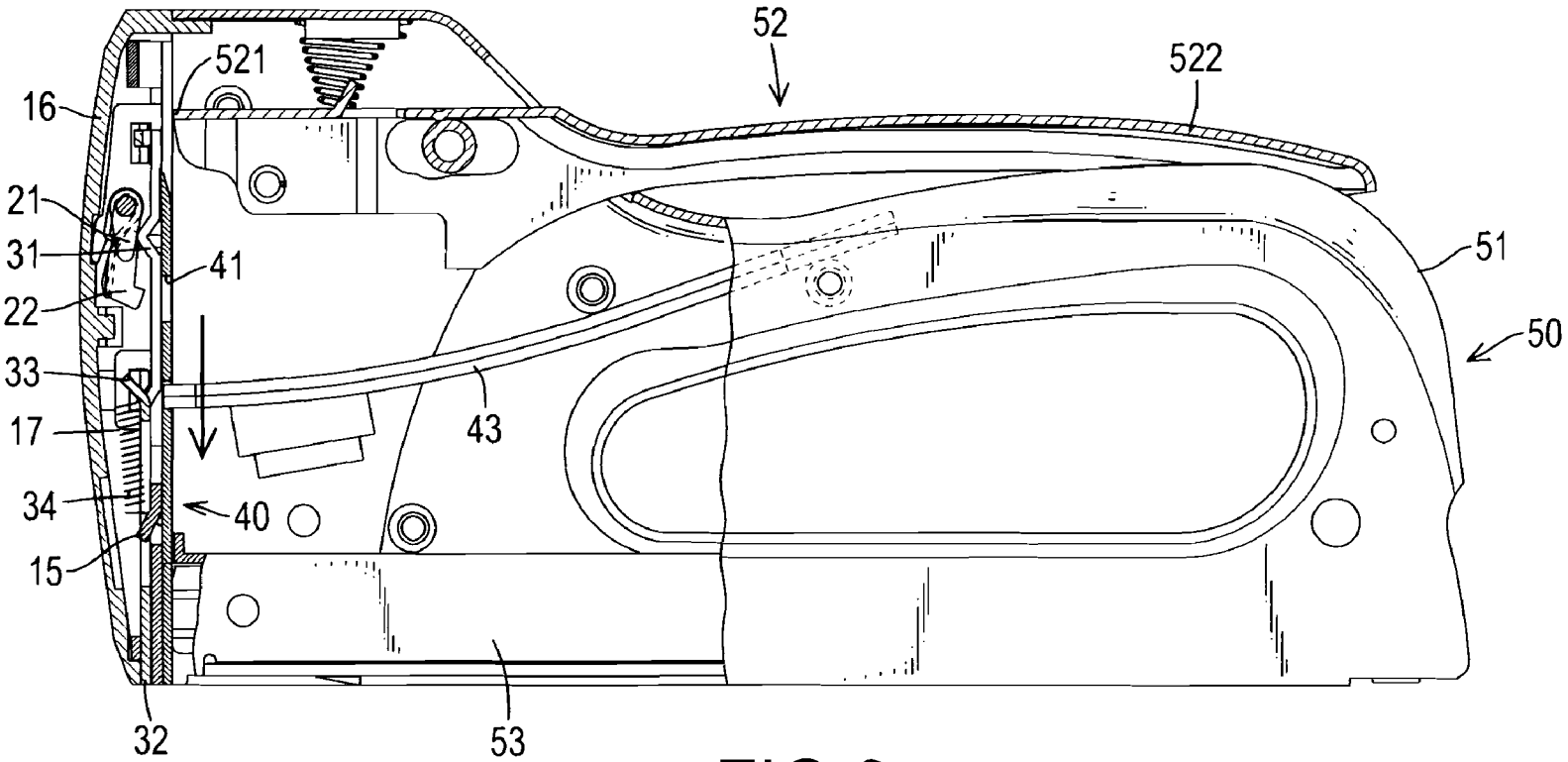

With reference to FIGS. 4 to 6, when a user wants to use the staple gun (50) that has the latch assembly in accordance with the present invention to drive staples into an object, first the pressing pin (32) of the pushing element (30) is placed on a surface of the object to make the pushing lever (31) move upward relative to the front cover (10) and the housing (51) to push the at least one cam (21). When the at least one cam (21) is pushed by the pushing lever (31) of the pushing element (30), the locking element (20) will rotate relative to the connecting bolt (12) and the locking end (221) of the locking block (22) will separate from the locking hole (41) of the staple driver (40) and the acting end (521) of the handle (52) will engage in the locking hole (41) of the staple driver (40). Then, pressing the pressing end (522) of the handle (52) relative to the housing (51) of the staple gun (50), and the staple driver (40) will move upward relative to the front cover (10) and the elastic panel (43) that engages the through hole (42) of the staple driver (40) will be bent by the staple driver (40). When the pressing end (522) of the handle (52) moves close to the top edge of the housing (51), the acting end (521) of the handle (52) will separate from the locking hole (41) of the staple driver (40). Then, the bent elastic panel (43) will provide an impulsive force to the staple driver (40) to eject the staples in the staple magazine (53) out of the staple gun (50) into the object.

When moving the staple gun (50) away from the surface of the object, the pushing spring (34) between the spring mounts (15, 33) will push the pressing pin (32) of the pushing element (30) out of the bottom of the cover (10) and the locking element (20) will be rotated relative to the connecting bolt (12) of the cover (10) by the torsion spring (23) to make the locking block (22) move back to an original position and make the locking end (221) of the locking block (22) securely engage the locking hole (41) of the staple driver (40) so preventing staples being shoot from the staple gun (50) when the handle (52) of the staple gun (50) is thoughtlessly squeezed.

By simplifying design of the latch assembly in accordance with the present invention for the staple gun (50), manufacture and assemble are cheaper and quicker.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A latch assembly for a staple gun having a housing, a handle connected pivotally to the housing and a staple magazine mounted in the housing below the handle and the latch assembly comprising a front cover being adapted to detachably mount on the housing and having
- a top;
- a bottom;
- a front side;
- two sidewalls;
- two bolt holes being transversally formed through the front side of the front cover near the top and aligning with each other;
- a connecting bolt being mounted in the bolt holes of the front cover;
- and a protecting cap being detachably mounted on the front side of the front cover to form a mounting recess between the front cover and the protecting cap;
- a locking element being pivotally mounted on the front cover and having at least one cam being rotatably mounted around the connecting bolt of the front cover;
- a locking block being formed with the at least one cam below the connecting bolt and having a locking end extending to the front side of the front cover; and
- a torsion spring being mounted around the connecting bolt of the front cover to push the locking block to the front side of the front cover;
- a pushing element being slidably mounted in the mounting recess between the protecting cap and the front cover and having
  - an upper end;
  - a lower end;
  - a pushing lever being formed on the upper end of the pushing element and abutting the at least one cam; and
  - a pressing pin being formed on the lower end of the pushing element and extending out of the bottom of the front cover; and
  - a staple driver being mounted slidably between the front cover and the staple gun and having
    - a lower end extending to over the staple magazine of the staple gun;
    - an upper end;
    - a locking hole being formed through the staple driver near the upper end, engaging the locking end of the locking block and being adapted to align with the handle;
    - a through hole being formed through the staple driver below the locking hole; and
    - an elastic panel engaging the through hole of the staple driver in the staple gun to provide an impulsive force for the staple driver.

2. The latch assembly for a staple gun as claimed in claim 1, wherein the front cover has a first spring mount being formed on and protruding from the front side of the front cover near the bottom; and the pushing element has a second spring mount being formed on and protruding from the pushing element above the first spring mount of the front cover; and a pushing spring being mounted between the spring mounts to press the pressing pin downward and extending out of the bottom of the front cover.

3. The latch assembly for a staple gun as claimed in claim 2, wherein the locking element has two cams being rotatably mounted around the connecting bolt; and the locking block is formed between the two cams.

4. The latch assembly for a staple gun as claimed in claim 3, wherein the front cover is U-shaped and has multiple mounting holes being formed through the sidewalls of the front cover and aligning with each other; and multiple fasteners being mounted in the mounting holes of the front cover to connect the front cover with the housing of the staple gun.

5. The latch assembly for a staple gun as claimed in claim 4, wherein each cam of the locking element is water drop shaped.

6. The latch assembly for a staple gun as claimed in claim 1, wherein the locking element has two cams being rotatably mounted around the connecting bolt; and the locking block is formed between the two cams.

7. The latch assembly for a staple gun as claimed in claim 1, wherein the front cover is U-shaped and has multiple mounting holes being formed through the sidewalls of the front cover and aligning with each other; and multiple fasteners being mounted in the mounting holes of the front cover to connect the front cover with the housing of the staple gun.

8. The latch assembly for a staple gun as claimed in claim 1, wherein each one of the at least one cam of the locking element is water drop shaped.

* * * * *